US011198026B2

(12) United States Patent
Bogardus, Jr.

(10) Patent No.: US 11,198,026 B2
(45) Date of Patent: Dec. 14, 2021

(54) FALL RESTRAINT SYSTEM

(71) Applicant: Black Ash Outdoor Products, LLC, Saegertown, PA (US)

(72) Inventor: Wayne E. Bogardus, Jr., Saegertown, PA (US)

(73) Assignee: Black Ash Outdoor Products, LLC, Saegertown, PA (US)

( * ) Notice: Subject to any disclaimer, the term of this patent is extended or adjusted under 35 U.S.C. 154(b) by 0 days.

(21) Appl. No.: 14/922,418

(22) Filed: Oct. 26, 2015

(65) Prior Publication Data

US 2016/0114199 A1 Apr. 28, 2016

Related U.S. Application Data

(60) Provisional application No. 62/068,907, filed on Oct. 27, 2014.

(51) Int. Cl.
*A62B 35/00* (2006.01)
*E06C 7/18* (2006.01)

(52) U.S. Cl.
CPC ..... *A62B 35/0043* (2013.01); *E06C 7/186* (2013.01)

(58) Field of Classification Search
CPC .... A62B 1/02; A62B 1/06; A62B 1/10; A62B 1/14; A62B 35/0043; E06C 7/186
See application file for complete search history.

(56) References Cited

U.S. PATENT DOCUMENTS 293,689 A * 2/1884 Usborne ..... A62B 1/14 188/65.3
368,075 A * 8/1887 Diss ..... A62B 1/10 182/72

(Continued)

FOREIGN PATENT DOCUMENTS

EP 2399651 A1 * 12/2011 ..... A62B 1/14
FR 2815874 A1 * 5/2002 ..... A62B 1/14

(Continued)

OTHER PUBLICATIONS

Against, (n.d.). Dictionary.com Unabridged. Retrieved Mar. 15, 2018 from Dictionary.com website http://www.dictionary.com/browse/against (Year: 2018).*

*Primary Examiner* — Daniel P Cahn
*Assistant Examiner* — Candace L Bradford
(74) *Attorney, Agent, or Firm* — Jonathan M. D'Silva; MMI Intellectual Property

(57) ABSTRACT

A fall restraint system comprises a webbing and a restraint mechanism. The restraint mechanism comprises a first end and a second end. A cam is located at the first end. A plurality of washers is positioned in series from the second end with at least one of the washers located adjacent to the cam. The webbing is inserted into the restraint mechanism from the second end and wrapped in a serpentine path around the plurality of washers, around the cam, and out of the restraint mechanism through the first end such that the webbing is interposed between the cam and the washer located adjacent the cam. When the webbing is pulled through the restraint mechanism, the cam is rotated and presses the webbing against the washer located adjacent to the cam creating drag friction on the webbing and slowing the rate of movement of the webbing through the restraint mechanism.

8 Claims, 7 Drawing Sheets

(56) References Cited

U.S. PATENT DOCUMENTS 649,073 A * 5/1900 Racey ..... A62B 1/14 182/7
771,794 A * 10/1904 Davis ..... A62B 1/14 188/65.3
917,681 A * 4/1909 Thompson ..... A62B 1/14 188/65.5
930,580 A * 8/1909 Weinstock ..... A62B 1/10 182/236
3,739,875 A * 6/1973 Clark-Padwicki ..... A62B 1/10 182/192
4,145,027 A * 3/1979 Brimo ..... A62B 1/10 182/193
4,576,248 A * 3/1986 Marom ..... A62B 1/14 182/5
5,054,577 A * 10/1991 Petzl ..... A62B 1/14 182/5
5,145,036 A * 9/1992 Omalia ..... A62B 1/04 182/193
5,379,858 A * 1/1995 Sandoval ..... A62B 1/14 182/193
5,850,893 A * 12/1998 Hede ..... A62B 1/14 182/193
5,975,243 A * 11/1999 Lorbek ..... A62B 1/14 182/192
6,029,777 A * 2/2000 Rogelja ..... A62B 1/14 182/192
D442,289 S * 5/2001 Ziaylek, Jr ..... D25/64
6,446,753 B1 * 9/2002 Novak ..... A62B 1/14 182/193
6,899,203 B1 * 5/2005 Golden ..... A62B 1/14 182/5
8,794,392 B2 * 8/2014 Kowatsch ..... A62B 1/08 182/192
9,205,285 B2 * 12/2015 Jones ..... A62B 1/10
2006/0054386 A1 * 3/2006 Blackford ..... A62B 1/14 182/3
2006/0113147 A1 * 6/2006 Harris, Jr. ..... A62B 35/0093 182/3
2009/0120720 A1 * 5/2009 Arms ..... A62B 1/14 182/193
2010/0122874 A1 * 5/2010 Harris, Jr. ..... A62B 1/14 182/231
2010/0163338 A1 * 7/2010 Wood ..... A62B 35/04 182/6
2011/0315480 A1 * 12/2011 Maurice ..... A62B 1/14 182/193
2012/0261212 A1 * 10/2012 Bonaiti ..... A62B 1/14 182/5
2013/0299275 A1 * 11/2013 Westermann ..... B65H 75/4423 182/3
2014/0041960 A1 * 2/2014 Jones ..... A62B 35/0037 182/5
2015/0217150 A1 * 8/2015 Harris ..... A62B 35/0093 182/5

FOREIGN PATENT DOCUMENTS

FR 3066396 A1 * 11/2018 ..... A62B 1/14
WO WO-2006035138 A1 * 4/2006 ..... A62B 1/14
WO 2006115468 A1 11/2006
WO WO-2006115468 A1 * 11/2006 ..... A63B 29/02
WO WO-2007098907 A1 * 9/2007 ..... A62B 1/10
WO WO-2010132012 A1 * 11/2010 ..... A62B 1/14

* cited by examiner

FALL RESTRAINT SYSTEM

This application takes priority from U.S. Provisional Patent Application No. 62/068,907 filed on Oct. 27, 2014, which is incorporated herein by reference.

BACKGROUND

Hunters, birdwatchers, and other like sporting enthusiasts often use an elevated stand or structure at some point while participating in their sport. Accidents can occur when the operator accidentally falls from the elevated stand or the elevated stand dislocates underneath their feet (often while the operator is mounting or dismounting from the elevated stand or preparing to take a shot). A fall restraint system has been developed to protect such operators from falling from the stand and injuring themselves. This fall restraint system uses friction against the bodyweight of its user to control the speed of descent after the initial fall. The fall restraint system also has the ability to adjust the rate of speed at which the user descents towards the ground after an initial fall.

Prior art mechanisms exist to address similar problems to those addressed by the fall restraint system disclosed herein. However, these prior art mechanisms require the use of at least one additional rope/line to keep the elevated stand user protected while mounting or dismounting from the elevated stand. Moreover, the fall restraint system disclosed herein can be used multiple times without the need for additional or routine maintenance. A user simply needs to rethread the fall restraint system to make it ready for a follow on use. After an initial use of these prior art mechanisms, they are required to be returned to the manufacturer for rethreading or they are to be discarded because the mechanism cannot be rethreaded and is simply for a one-time use. It should be understood that the system disclosed herein can also be applied to situations that protect the operators of building scaffolding, ladders, climbing applications (which includes, but not limited to, indoor and outdoor mountain climbing facilities), fire escape systems, and certain rescue operations.

SUMMARY

A fall restraint system is presented that comprises a webbing and a restraint mechanism. The restraint mechanism further comprises a first end and a second end. A cam is located at the first end. A plurality of washers is positioned in a staggered series from the second end with at least one of the washers located adjacent to the cam. The webbing is inserted into the restraint mechanism from the second end and is wrapped in a serpentine path around the plurality of washers, around the cam, and out of the restraint mechanism through the first end such that the webbing is interposed between the cam and the washer located adjacent to the cam. When the webbing is pulled through the restraint mechanism, the cam is rotated and presses the webbing against the washer located adjacent to the cam creating drag friction on the webbing and slowing the rate of movement of the webbing through the restraint mechanism.

The fall restraint system further comprises a base plate and a shelter plate to which the cam and the plurality of washers are mounted. In some embodiments of the fall restraint system, the washers have a circular cross-section. In some embodiments of the fall restraint system, the washers have a tear-drop shaped cross-section.

In various embodiments, the base plate and the shelter plate are made out of a material selected from the group consisting of metals, metal alloys, plastics, and wood. In various embodiments the webbing is made out of a material selected from the group consisting of polyester, polypropylene, nylon, or rayon. In various embodiments, the washers are made out of a material selected from the group consisting of polyoxymethylene, nylon, ceramic, or aluminum.

In some embodiments of the fall restraint system, a clamping assembly is mounted at the second end through which the webbing is inserted.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
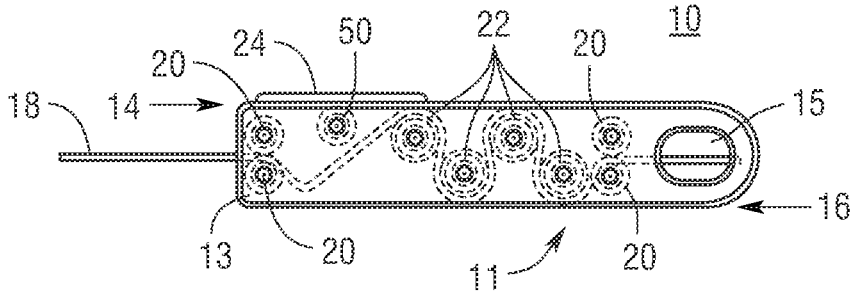
FIG. 1 is a top view of the fall restraint system.
Figure 2:
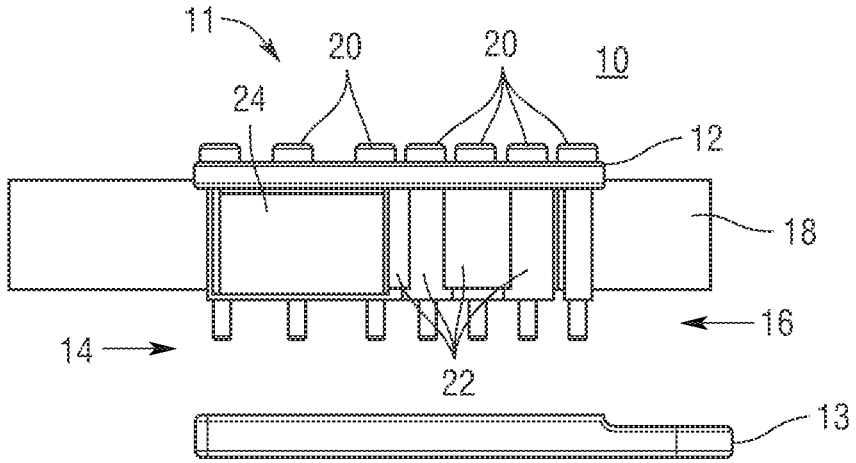
FIG. 2 is an exploded side view of the fall restraint system of FIG. 1.
Figure 3:
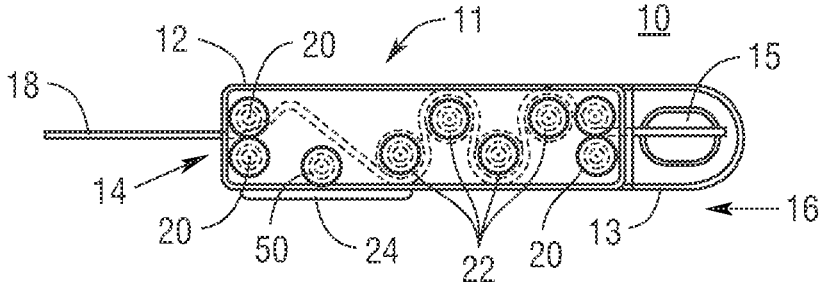
FIG. 3 is an cut-away top view of the fall restraint system of FIG. 1, without the shelter plate.
Figure 4:
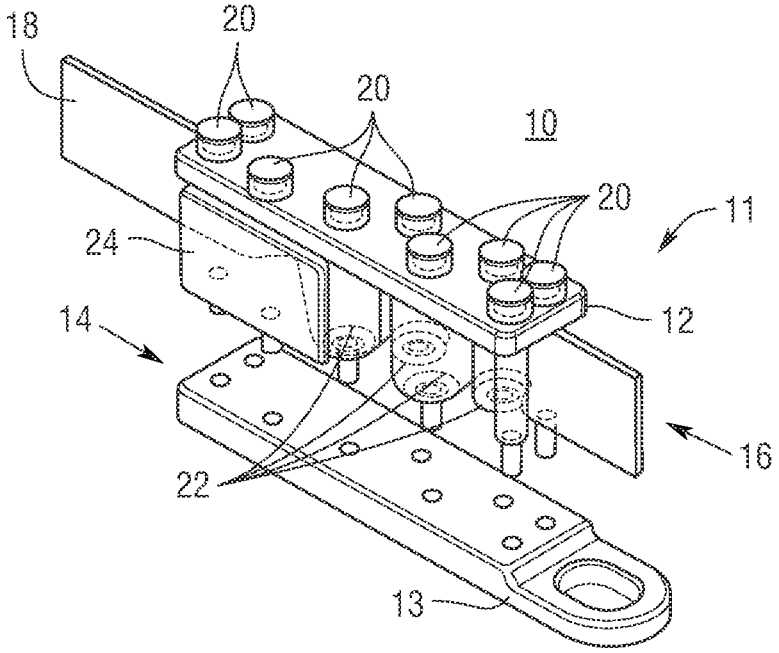
FIG. 4 is an exploded perspective view of the fall restraint system of FIG. 1.
Figure 5:
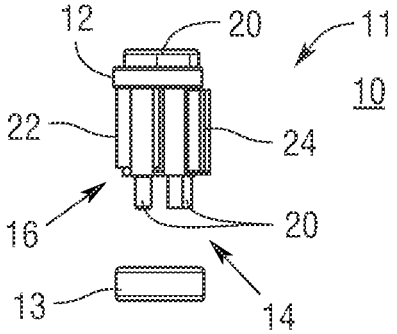
FIG. 5 is an exploded forward-facing side view of the fall restraint system of FIG. 1.
Figure 6:
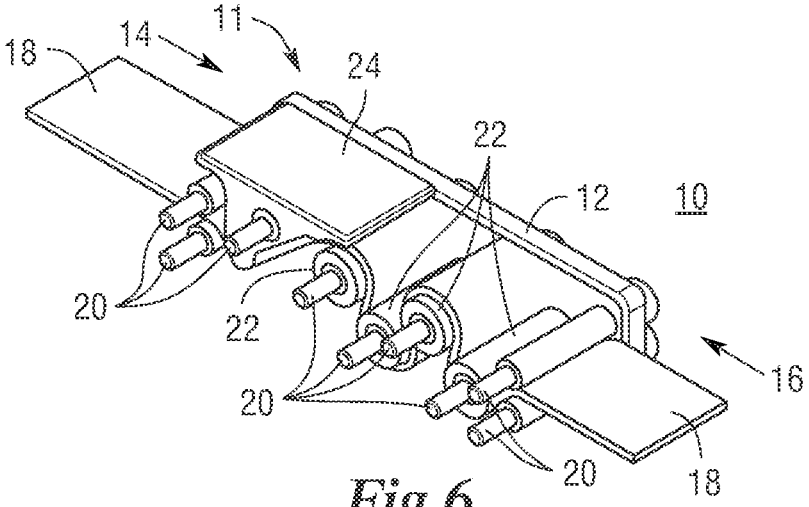
FIG. 6 is a perspective view of the fall restraint system of FIG. 1, without the shelter plate.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

As shown in FIGS. 1 through 6, the fall restraint system 10 includes a restraint mechanism 11 and webbing 18. The restraint mechanism 11 includes a shelter plate 12, a base plate 13, a first end 14 and a second end 16. When the restraint mechanism 11 is properly constructed, a number of bolts 20 connect the shelter plate 12 to the base plate 13. A restraint hole 15 is located on the base plate 13 for securing the fall restraint system 10 as described in more detail below. The webbing 18 is inserted into the restraint mechanism 11 from the second end 16 and is wrapped in a circuitous, serpentine path around a series of inner components, including the bolts 20, washers 22, and a cam 24, and out of the restraint mechanism 11 from the first end 14. As discussed in detail below, the webbing 18 is loose within the restraint mechanism 11 of the fall restraint system 10 while a user (not shown) is on an elevated stand (not shown). This allows the webbing 18 to easily slide back and forth between the inner components of the restraint mechanism 11. However, if the user free falls from this elevated stand, the bolts 20, washers 22, and cam 24 press against the webbing 18, which quickly creates drag friction between the inner components of the restraint mechanism 11 and the webbing 18. This interaction causes the user's own bodyweight to gridlock the webbing 18 against the inner components of the restraint mechanism 11, drastically slowing the movement of the restraint mechanism 11 along the webbing 18.

The shelter plate 12 provides spacing, protection, and stability for the inner functions of the restraint mechanism 11. In this embodiment, the shelter plate 12 is constructed from a solid piece of material, which is aluminum. However, the shelter plate 12 can be constructed from other materials, including, but not limited to—steel, some variety of plastic, wood, titanium, or some variety of metal alloy. It should be noted that the shelter plate 12 may be any number of different colors depending on the specific use of the fall restraint system 10. In this embodiment, the shelter plate 12 incorporates nine holes 42 spaced in a serpentine pattern. Each hole 42 accommodates either a bolt 20 and washer 22 combination or a bolt 20 and cam 24 combination, such that the bolt 20 is releasably joined to the shelter plate 12. It should also be understood that a skilled artisan will see that other embodiments of the shelter plate 12 may include more or less than nine holes 42 and that the series of holes 42 can be spaced in a variety of different serpentine patterns.

The bolts 20 and washers 22 closest to the second end 16 of the restraint mechanism 11 are positioned in such a way to create a pinching effect on the webbing 18. This pinching effect helps to stabilize the webbing 18 and make sure the webbing leaves the restraint mechanism 11 through the central axis (not shown) of the restraint mechanism 11. The pinching effect also creates additional drag friction on the webbing, ensuring the restraint mechanism 11 is stopped from freely moving along the webbing 18 after the restraint mechanism 11 is activated during a fall.

Figure 7:
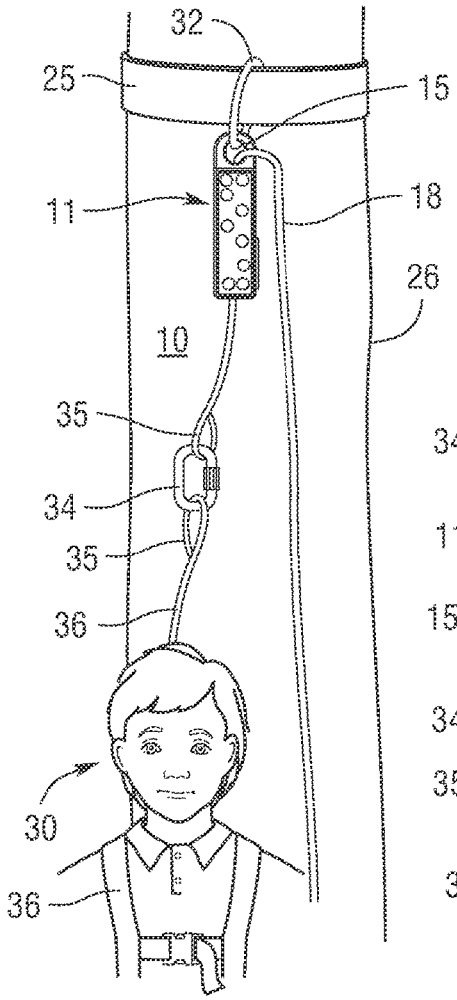
FIG. 7 depicts the fall restraint system in the environment in which it would be used.

As shown in FIG. 7, for the fall restraint system 10 to work properly, the webbing 18 must be properly secured to some kind of stable and erect body 26 (e.g. a tree or post). In this embodiment, the webbing 18 secures to the erect body 26 through a restraint strap 28 that wraps entirely around the erect body 26. The restraint strap 28 and webbing 18 are used to protectively secure the user to the erect body 26 while they ascend up to and mount onto the elevated stand (not shown) or dismount off of and descend from the elevated stand. When the user 30 free falls from this elevated stand, the weight of the user and gravity causes the bolts 20, washers 22, and cam 24 in the restraint mechanism 11 to press against the webbing 18 and slow down the movement of the webbing 18 through the restraint mechanism 11. This slows down the fall of the user to a safe rate of speed When properly secured, the webbing 18 dangles next to the erect body 26, starting from the restraint strap 28 and going down to the ground level (or close to ground level). As shown, a safety hook 32 attaches the fall restraint system 10 through the restraint hole 15 to the restraint strap 28. A carabineer 34 attaches the user 30 to the webbing 18 via a safety vest 36 (typically embodied as a certified safety harness that meets the safety guidelines of the Tree Stand Manufacturers Association). The restraint strap 28 is typically made from polyester, polypropylene, nylon, or rayon, but can be made from any material strong enough hold the bodyweight of the user 30 above the ground. In this configuration, the restraining system 11 is not connected directly to the user and it works to slow the movement of the webbing 18 as it passes through.

Figure 8:
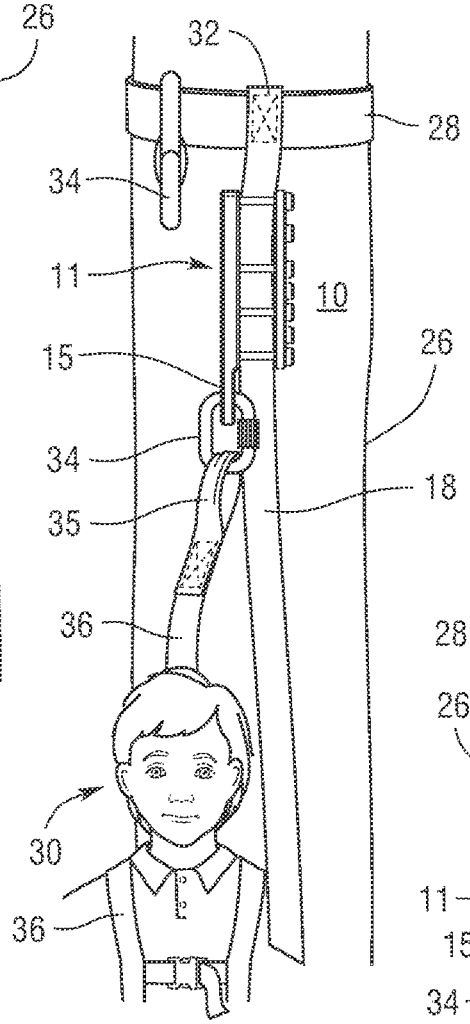
FIG. 8 depicts the fall restraint system of FIG. 1 attached to another embodiment of the restraint strap and in the environment in which it would be used.

As shown in FIG. 8, in other configurations, the webbing 18 can be directly sewed 38 on to the restraint strap 28. In this embodiment, the webbing 18 and restraint strap 28 work as one unitary piece to which the restraining mechanism 11 is connected. In this configuration the user is connected directly to the restraining mechanism 11 with a carabineer 34 mounted to the restraint hole 15. In this configuration, as the user falls restraining system 11 is slowed as is passes through the webbing 28.

Figure 9:
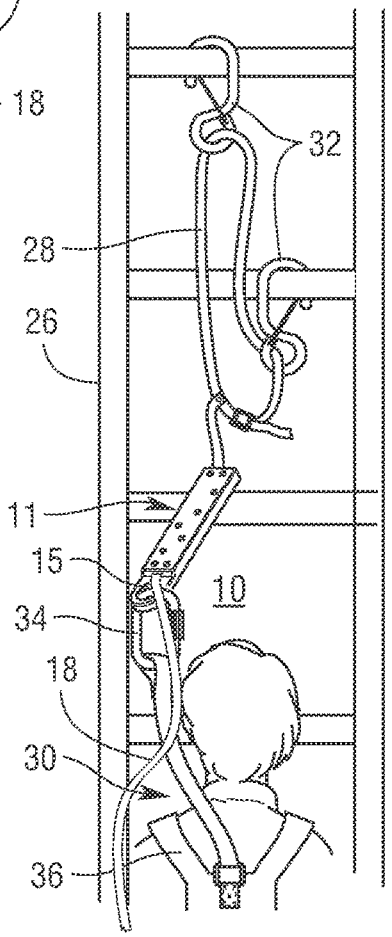
FIG. 9 depicts the fall restraint system of FIG. 1 attached to the embodiment of the restraint strap of FIG. 8 and in the environment in which it would be used.

FIG. 9 shows a configuration of the fall restraint system 10 properly secured to an erect body 26 that is a ladder. To accomplish this, two safety hooks 32 connect the erect body 26 to the restraint strap 28. Each safety hook 32 is connected to a separate rung of the erect body 26 to ensure the restraint strap 28 is properly secured to hold the body weight of the user 30. The carabineer 34 connects the safety vest 36 directly to the restraining system 11 through the restraint hole 15.

Figure 10:
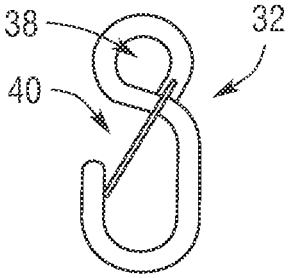
FIG. 10 is a side view of a safety hook.
Figure 11:
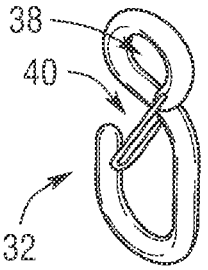
FIG. 11 is a perspective view of the safety hook of FIG. 10.

As shown in FIGS. 10 and 11, each safety hook 32 includes an eye hole 38 and a clipped portion 40. The restraint strap 28 is typically strewn through the eye hole 38 and the clipped portion 40 connects to a rung of the erect body 26. However, other orientations may exist depending on the embodiment of the safety hook 32. Each safety hook is typically made from steel or stainless steel and includes a rubber coating. Once the user is adequately positioned on the elevated stand, an unused safety hook 32 could possibly be used to carry equipment to and from the top of the erect body 26.

Figure 12:
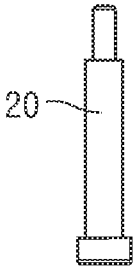
FIG. 12 is a side view of a bolt.
Figure 13:
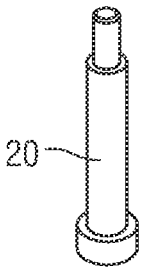
FIG. 13 is a perspective view of the bolt of FIG. 12.

As shown in FIGS. 12 and 13, each bolt 20 is embodied as a long shoulder bolt. The tip 21 of the bolt 20 inserts into the base plate (13, shown earlier) to releasably join the bolt 20 to the base plate. Each bolt 20 is typically made from stainless steel or steel but could be made from other materials, such as, but not limited to, some variety of plastic, wood, titanium, or some variety of metal alloy. Other embodiments of the bolt 20 may be incorporated to accommodate different, shapes, widths and varieties of webbing 18. One of ordinary skill in the art will see that other embodiments of the bolt 20 can work in the restraint mechanism 11, these embodiments include, but are not limited to, carriage bolts, hex bolts, and machine screws. It should be noted that one bolt 20 could have a different embodiment from the other corresponding bolts 20 in the restraint mechanism 11.

Figure 14:
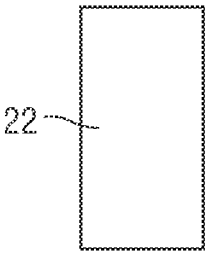
FIG. 14 is a side view of a washer.
Figure 15:
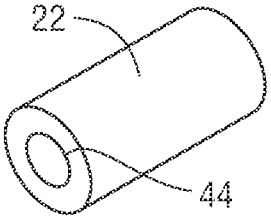
FIG. 15 is a perspective view of the washer of FIG. 14.
Figure 16:
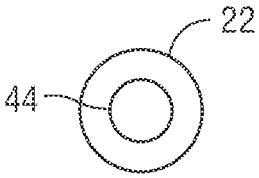
FIG. 16 is a top view of the washer of FIG. 14.

As shown in FIGS. 14 through 16, the washer 22 is typically embodied as an elongated tube. The washer 22 is typically made from nylon, due to the material's friction creating property when used against the webbing (not shown). However, the washer 22 may be made from other materials such as, but not limited to, polyoxymethylene (sometimes commercialized under the trademark "DELRIN"), ceramic, or aluminum. When the restraint mechanism 11 is properly constructed, the respective bolt 20 inserts into the washer hole 44 and goes through the central axis of the washer 22. Due to the placement of the bolts 20, the washers 22 are staggered in a serpentine pattern within the restraint mechanism 11. This serpentine pattern provides a proper amount of drag created friction against the webbing 18, around the diameter of each washer 22 as well as pinch between certain washers 22.

Figure 17:
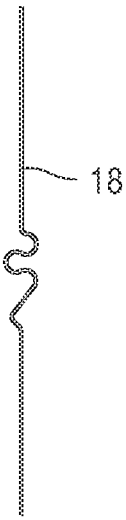
FIG. 17 is a side view of webbing.
Figure 18:
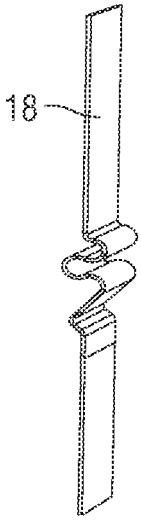
FIG. 18 is a perspective view of the webbing of FIG. 17.

As shown in FIGS. 17 and 18, the webbing 18 is typically embodied as a unitary-elongated strip of cloth material. The webbing 18 is typically made from, but not limited to, polyester, polypropylene, nylon, or rayon. The webbing 18 can be made to have a wide array of color and pattern choices, depending on a particular application. In certain embodiments, as with the configuration shown in FIG. 7, the webbing includes a loop 35 located at one end. This loop 35 allows a carabineer 34 to secure the safety vest 36 to the webbing 18. The loop 35 also allows the carabineer 34 to be secured to the webbing 18 and used to carry the equipment (not shown) to and from the elevated stand (not shown). As discussed above, the webbing 18 can be directly attached to the user's restraint strap 28 or to the restraint strap 28 via a carabineer 32.

Figure 19:
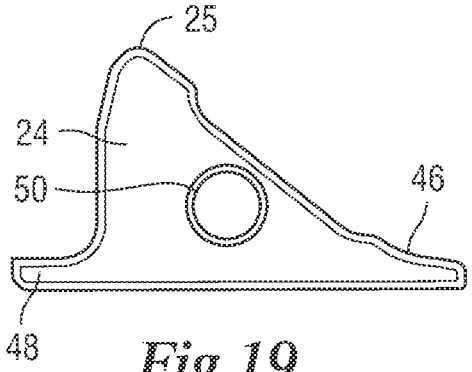
FIG. 19 is a side view of a cam.
Figure 20:
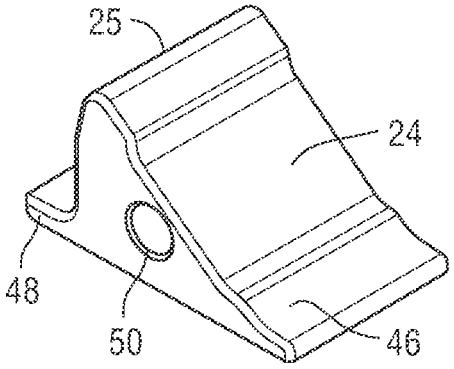
FIG. 20 is a perspective view of the cam of FIG. 19.

As shown in FIGS. 19 and 20, the cam 24 comprises a pressure point 25, lever 46, tab 48, and cam hole 50. The cam 24 is typically machined or die cast and is typically constructed from zinc or aluminum, but can be made from other materials, including, but not limited to—steel, some variety of plastic, wood, titanium, or some variety of metal alloy. It should be understood that the cam 24 can be different colors for differentiation of user bodyweight ranges or other uses of the fall restraint system 10. The cam 24 could possibly have the weight range engraved somewhere on its body, to prevent users from using a fall restraint system 10 constructed for the wrong body weight range.

Figure 21:
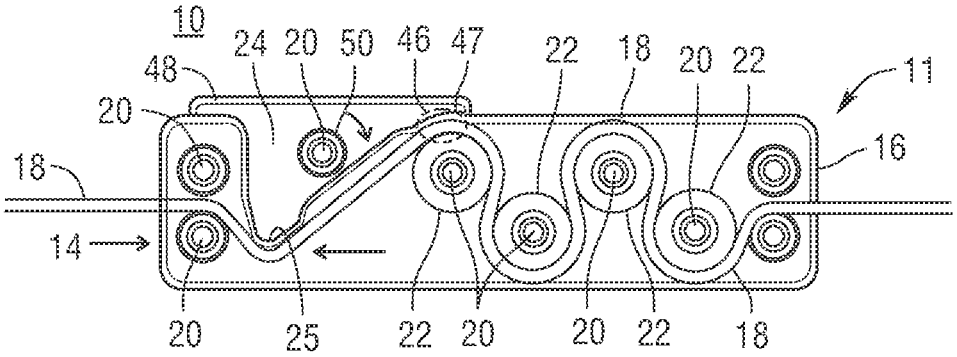
FIG. 21 is a cut-away top view of the restraint mechanism emphasizing the functioning of the cam.

As shown in the cross section of the fall restraint system 10 in FIG. 21, the cam 24 is rotatably connected to a bolt 20 that is generally closer to the first end 14 than the second end 16 of the restraint mechanism 11. The cam 24 is rotatably connected to the bolt 20 via the cam hole 50. The cam 24 functions to provide adjustability for the bodyweight of the user being exerted on the fall restraint system 10. As the bodyweight of the user is applied, the cam 24 and the washers 22 work in conjunction to slow the relative speed of movement of the webbing 18 so that it slides through the restraint mechanism 11 at a reasonable rate of speed.

If the user falls and the webbing 18 is pulled through the first end 14 and become taut, the cam 24 is actuated by the webbing 18 which forces the pressure point 25 to be rotated towards the bolts 20 located at the first end 14. This causes the lever 46 of the cam 24 to press against the webbing 18 at area 47, creating drag friction on the webbing 18 at area 47 and slowing the rate of movement of the webbing 18 through the restraint mechanism 11. A user can pull the lever 46 away from the webbing 18, which reduces the drag friction and allowing the webbing 18 to slide through the restraint mechanism 11 at a faster rate of speed. When the lever 46 is pulled away from the rest of the restraint mechanism 11, the tab 48 serves as a limit to how far the cam may be rotated when the tab 48 comes into contact with one of the bolts 20 located at the first end 14. Other embodiments of the cam 24 modify the distance of the pressure point 25 from the cam hole 50 to address differing user bodyweight ranges for the fall restraint system 10. Locating the pressure point 25 closer to the cam hole 50 accommodates users having generally lighter bodyweights. When the pressure point 25 is farther from the cam hole 50, the cam 24 can accommodate users having generally heavier bodyweights.

Figure 22:
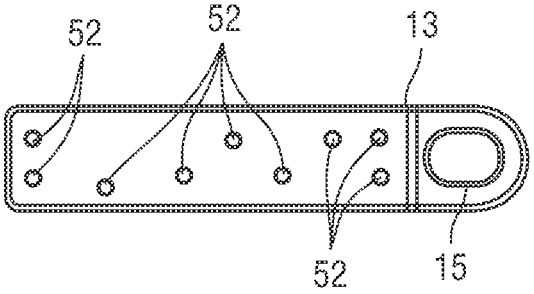
FIG. 22 is a top view of the base plate.
Figure 23:
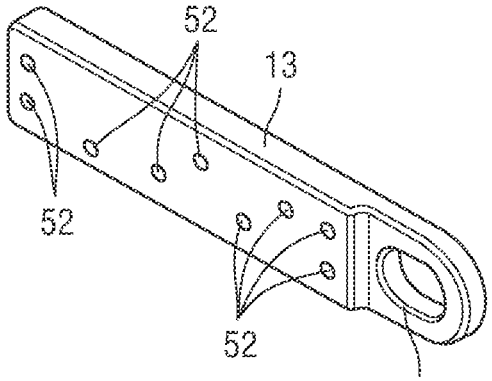
FIG. 23 is a perspective view of the base plate of FIG. 22.

As shown in FIGS. 22 and 23, the base plate 13 provides a location that the bolts (not shown) releasably secure. The base plate 13 also provides additional stability, protection, and spacing of the inner functions of the whole restraint mechanism (not shown). In this embodiment, the base plate 13 is constructed from a solid piece of material, which is typically aluminum. However, the base plate 13 can be constructed from other materials, including, but not limited to—steel, molded plastics, wood, titanium, or die case from some type of alloy. The base plate 13 comprises a series of nine base holes 52 spaced in a serpentine pattern that directly correlates to the serpentine pattern from the shelter plate (not shown) and a restraint hole 15. It should be noted that the base plate 13 may be any number of different colors depending on the specific use of the fall restraint system. It should also be understood that a skilled artisan will see that other embodiments of the base plate 13 may include more or less than nine holes and that each hole can be spaced in a variety of different serpentine patterns.

Each base hole 52 accommodates each corresponding bolt (20, as shown earlier) releasably joined to the shelter plate (12, shown earlier). In certain embodiments, the base holes 52 may each be threaded so the bolt can releasably secure directly to the base plate 13. In other embodiments, the bolts may be inserted into the base hole 52 and a bolt be used to releasably secure the bolt to the base plate 13. The restraint hole 15 allows the carabineer (32, shown earlier) to attach to the rest of the restraint mechanism.

Figure 24:
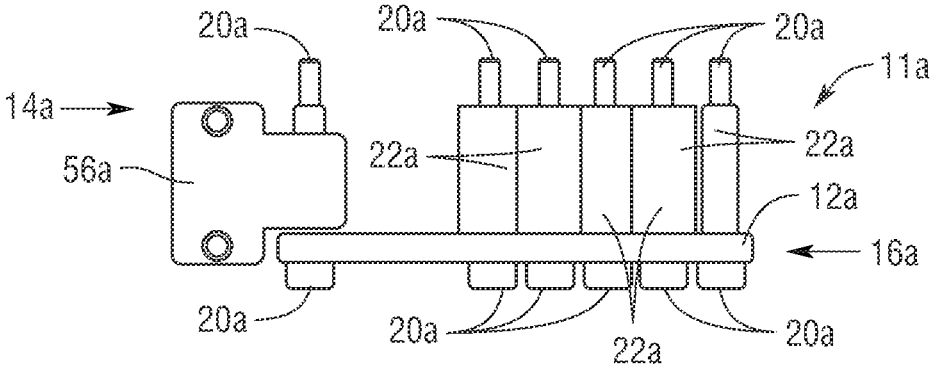
FIG. 24 is a top view of another embodiment of the restraint mechanism, without the base plate.
Figure 25:
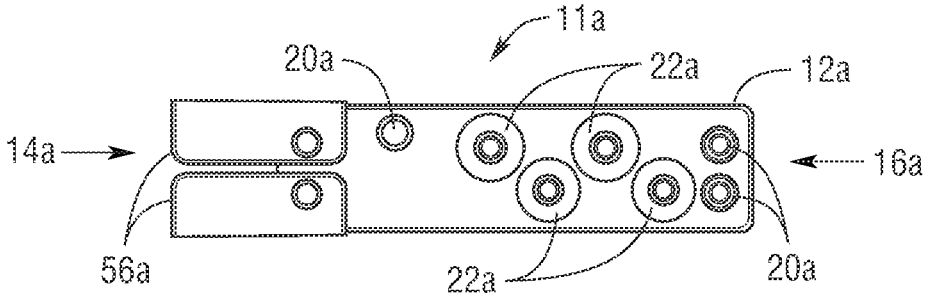
FIG. 25 is a side view of the restraint mechanism of FIG. 24.
Figure 26:
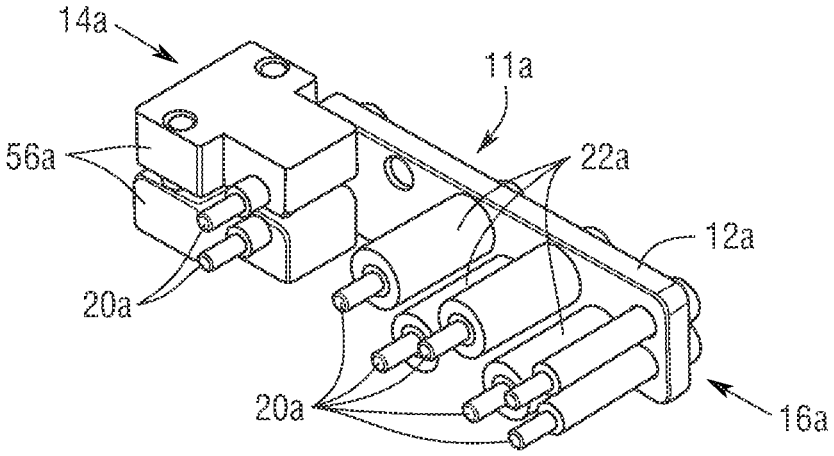
FIG. 26 is a perspective view of the restraint mechanism of FIG. 24.
Figure 27:
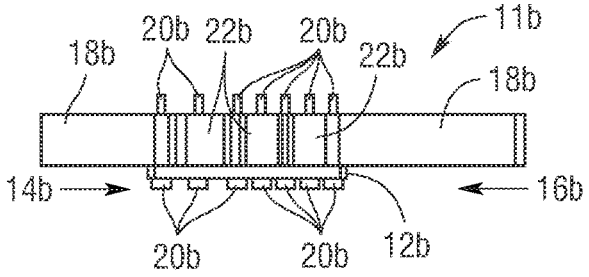
FIG. 27 is an exploded side view of another embodiment of the fall restraint system, without the base plate.
Figure 28:
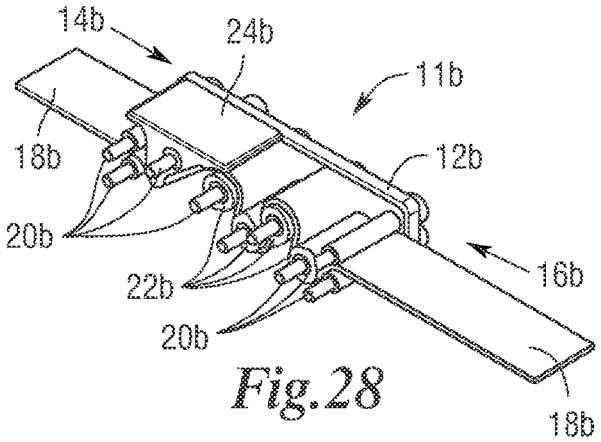
FIG. 28 is an exploded perspective view of the fall restraint system of FIG. 27, without the base plate.
Figure 29:
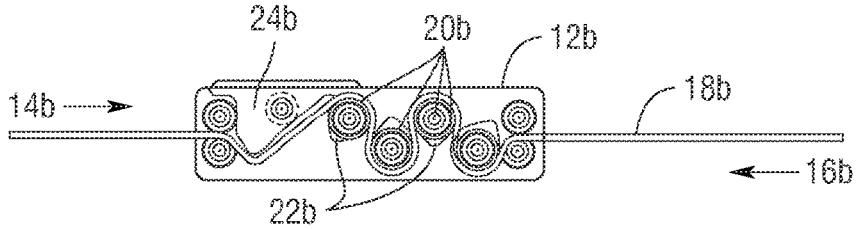
FIG. 29 is an exploded top view of the fall restraint system of FIG. 27, without the base plate.
Figure 30:
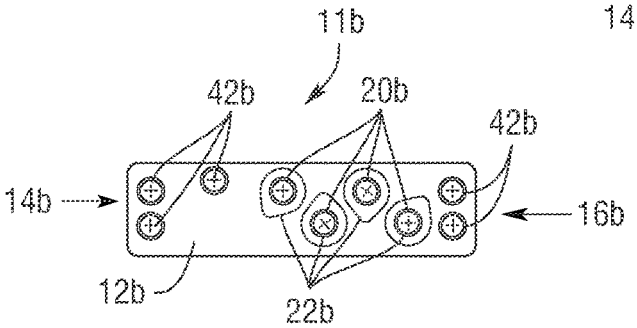
FIG. 30 is a side view of the shelter plate of the restraint mechanism of FIG. 27.
Figure 31:
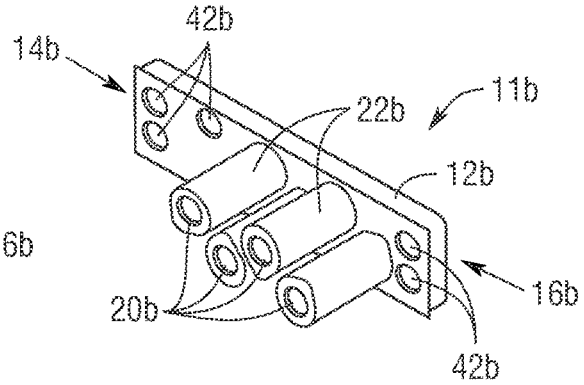
FIG. 31 is a perspective view of the shelter plate of the restraint mechanism of FIG. 27.

As shown in FIGS. 24 through 26, a clamping assembly **56*a* may be joined to the bolts 20*a* and washers 22*a* closest to the first end 14*a* of the restraint mechanism 11*a*. The cam has been removed from the drawing to illustrate the location of the clamping assembly 56*a*. The clamping assembly 56*a* creates a stronger pinching effect on the webbing (not shown) than that created by just the bolts 20*a* and washers 22*a* being in this location within the restraint mechanism 11*a*. The pinching effect creating by the clamping assembly 56*a* helps to stabilize the webbing and make sure the webbing leaves the restraint mechanism 11*a* at its central axis (not shown). This pinching effect also creates additional drag friction on the webbing, ensuring the restraint mechanism 11*a* is stopped from freely moving along the webbing 18*a***.

As shown in FIGS. 27 through 31, the shelter plate **12*b* and the washers 22*b* do not have to have a circular cross-section but instead has a tear-drop shaped cross-section that can more effectively create drag friction on the webbing 18*b* sliding through the restraint mechanism 11*b***.

Third party test of the fall restraint system described herein was conducted through a third party testing laboratory. Drop tests were conducted on a 220-pound test mannequin attached to a 10-inch diameter tree. The mannequin was further connected to a standard fall arrest harness and drop tested in various configurations in which the fall restraint system was used and not used. In each configuration, the mannequin was dropped 52-inches (twice the free length of the webbing of the standard fall arrest harness used). With a straight lanyard harness system, the 52-inch fall generated 1,500 pounds of impact force, a drop of the same height with a sewn over lanyard harness system generated 1,133 pounds of impact force, and a drop of the same height performed using the fall restraint system described herein generated only 387 pounds of impact force. In addition, the fall restraint system lowered the mannequin to the floor safely rather than putting a sudden impact stop as some prior art safety systems are designed to do.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A fall restraint system comprising:

webbing and a restraint mechanism;

said restraint mechanism comprising:

a first end and a second end;

a cam located at said first end;

a plurality of washers positioned in a staggered series from said second end with at least one of said washers located adjacent to said cam;

said webbing is inserted into said restraint mechanism from said second end, around and against said cam, and is wrapped in a serpentine path around said plurality of washers, and out of said restraint mechanism through said first end such that said webbing is interposed between said cam and said washer located adjacent to said cam;

during descent of said restraint mechanism with respect to said webbing, said webbing is pulled out through said first end of said restraint mechanism under the weight of a load causing said cam to rotate and press said webbing against said washer located adjacent to said cam creating drag friction on said webbing and slowing the rate of movement of said webbing through said restraint mechanism to a safe descent speed.

2. The fall restraint system of claim 1 in which said restraint mechanism further comprises a base plate and a shelter plate to which said cam and said plurality of washers are mounted.

3. The fall restraint system of claim 1 in which said restraint mechanism further comprises a base plate and a shelter plate to which said cam and said plurality of washers are mounted and said base plate and said shelter plate are made out of a material selected from the group consisting of metals, metal alloys, plastics, and wood.

4. The fall restraint system of claim 1 in which said webbing is made out of a material selected from the group consisting of polyester, polypropylene, nylon, and rayon.

5. The fall restraint system of claim 1 in which said washers are made out of a material selected from the group consisting of polyoxymethylene, ceramic, nylon, and aluminum.

6. The fall restraint system of claim 1 in which a clamping assembly is mounted at said first end.

7. The fall restraint system of claim 1 in which said washers have a circular cross-section.

8. The fall restraint system of claim 1 in which said washers have a tear-drop shaped cross-section.

* * * * *